US009790789B2

(12) United States Patent
Hejl et al.

(10) Patent No.: US 9,790,789 B2
(45) Date of Patent: Oct. 17, 2017

(54) APPARATUS AND METHOD FOR OBTAINING FORMATION FLUID SAMPLES

(71) Applicants: David A. Hejl, Houston, TX (US); Shawn Olsen, Spring, TX (US)

(72) Inventors: David A. Hejl, Houston, TX (US); Shawn Olsen, Spring, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 223 days.

(21) Appl. No.: 13/724,919

(22) Filed: Dec. 21, 2012

(65) Prior Publication Data

US 2014/0174169 A1 Jun. 26, 2014

(51) Int. Cl.
*E21B 49/08* (2006.01)
*E21B 49/10* (2006.01)

(52) U.S. Cl.
CPC ..... *E21B 49/08* (2013.01); *E21B 49/10* (2013.01)

(58) Field of Classification Search
CPC ..... E21B 49/10; E21B 49/08
USPC ..... 73/152.23–152.26; 166/100, 264
See application file for complete search history.

(56) References Cited

U.S. PATENT DOCUMENTS 4,862,958 A * 9/1989 Pringle ..... 166/72
5,279,153 A * 1/1994 Dussan ..... 73/152.06
6,769,296 B2 8/2004 Montalvo et al.
6,964,301 B2 11/2005 Hill et al.
7,114,385 B2 10/2006 Fisseler et al.
7,458,419 B2 12/2008 Nold, III et al.
7,484,563 B2 * 2/2009 Zazovsky et al. ..... 166/264
7,584,655 B2 9/2009 van Zuilekom et al.
7,584,786 B2 9/2009 Nold, III et al.
7,603,897 B2 10/2009 Gilbert et al.
7,793,713 B2 9/2010 Nold, III et al.
7,857,049 B2 12/2010 Sherwood
7,997,341 B2 * 8/2011 Briquet et al. ..... 166/264
8,210,260 B2 * 7/2012 Milkovisch et al. ..... 166/264
2003/0145652 A1 * 8/2003 Arian ..... 73/152.26
2006/0042793 A1 3/2006 Del Campo et al.
2008/0115575 A1 * 5/2008 Meek et al. ..... 73/152.24
2009/0044951 A1 * 2/2009 Milkovisch et al. ..... 166/369
2012/0160514 A1 * 6/2012 Evans, II ..... E21B 49/10 166/373

OTHER PUBLICATIONS

Schlumberger MDT sampling tool Brochure 2002.*
PCT International Search Report and Written Opinion; International Application No. PCT/US2013/075684; dated Dec. 17, 2013; dated Mar. 27, 2014; pp. 1-16.

* cited by examiner

*Primary Examiner* — Peter Macchiarolo
*Assistant Examiner* — Anthony W Megna Fuentes
(74) *Attorney, Agent, or Firm* — Cantor Colburn LLP

(57) ABSTRACT

In one aspect, an apparatus for obtaining a fluid from a formation is disclosed that in one embodiment may include a fluid extraction device having a first probe and a second probe independently extendable form a tool body, a first fluid line and an associated first filter in fluid communication with the first probe for receiving the fluid from the formation and a second fluid line and an associated second filter in fluid communication with the second probe for receiving the fluid from the formation, and a first fixed scraper that cleans the first filter when the first probe is retracted from an extended position and a second fixed scraper that cleans the second filter when the second probe is retracted from an extended position.

20 Claims, 3 Drawing Sheets

APPARATUS AND METHOD FOR OBTAINING FORMATION FLUID SAMPLES

BACKGROUND OF THE DISCLOSURE

1. Field of the Disclosure

The present disclosure relates generally to apparatus and methods for formation fluid collection and testing.

2. Description of the Related Art

During both drilling of a wellbore and after drilling, clean fluid from the formation is often extracted to determine the nature of the hydrocarbons in hydrocarbon-bearing formations. Fluid samples are often collected in multiple chambers and the collected samples are tested to determine various properties of the extracted formation fluid. To drill a well, drilling fluid is circulated under pressure greater than the pressure of the formation in which the well is drilled. The drilling fluid invades into the formation and contaminates the connate fluid in formation to varying depths, referred to as the invaded zone. To collect samples of the original fluid present in the formation (also referred to as the connate fluid), a formation testing tool is conveyed into the wellbore. A pump typically extracts the formation fluid via a sealed probe placed against the inside wall of the wellbore. The fluid is tested for contamination and when the extracted fluid is sufficiently clean, samples are collected in chambers for further analysis. Single and concentric probes have been proposed for extracting formation fluid. In a concentric probe, an outer probe surrounding an inner probe deflects the contaminated fluid away from the inner probe, which enables faster drainage of the contaminated fluid from the invaded zone and thus the collection of the connate fluid samples.

The disclosure herein provides a formation evaluation system with an alternative fluid extraction system.

SUMMARY

In one aspect, an apparatus for obtaining a fluid from a formation is disclosed that in one embodiment may include a fluid extraction device that includes a first probe and a second probe independently extendable from a tool body, a first fluid line and an associated first filter in fluid communication with the first probe for receiving the fluid from the formation and a second fluid line and an associated second filter in fluid communication with the second probe for receiving the fluid from the formation, and a first fixed scraper that cleans the first filter when the first probe is retracted from an extended position and a second fixed scraper that cleans the second filter when the second probe is retracted from an extended position.

In another aspect, a method of obtaining a sample from a formation is disclosed that in one embodiment may include: providing a tool that includes a first probe and a second probe independently extendable from a tool body, a first fluid line and an associated first filter in fluid communication with the first probe for receiving the fluid from the formation and a second fluid line and an associated second filter in fluid communication with the second probe for receiving the fluid from the formation, and a first fixed scraper that cleans the first filter when the first probe is retracted from an extended position and a second fixed scraper that cleans the second filter when the second probe is retracted from an extended position; conveying the tool in a wellbore; extending the first probe and the second probe to contact an inside wall of the wellbore; extracting fluid from the formation via one of the first probe and the second probe and determining when such extracted fluid is substantially free of contamination; and collecting a fluid sample from the formation via the first probe after determining the extracted fluid is substantially free of contamination.

Examples of certain features of the apparatus and methods disclosed herein are summarized rather broadly in order that the detailed description thereof that follows may be better understood. There are, of course, additional features of the apparatus and methods disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, in which like elements have generally been given like numerals and wherein.

DESCRIPTION OF THE DISCLOSURE

Figure 1:
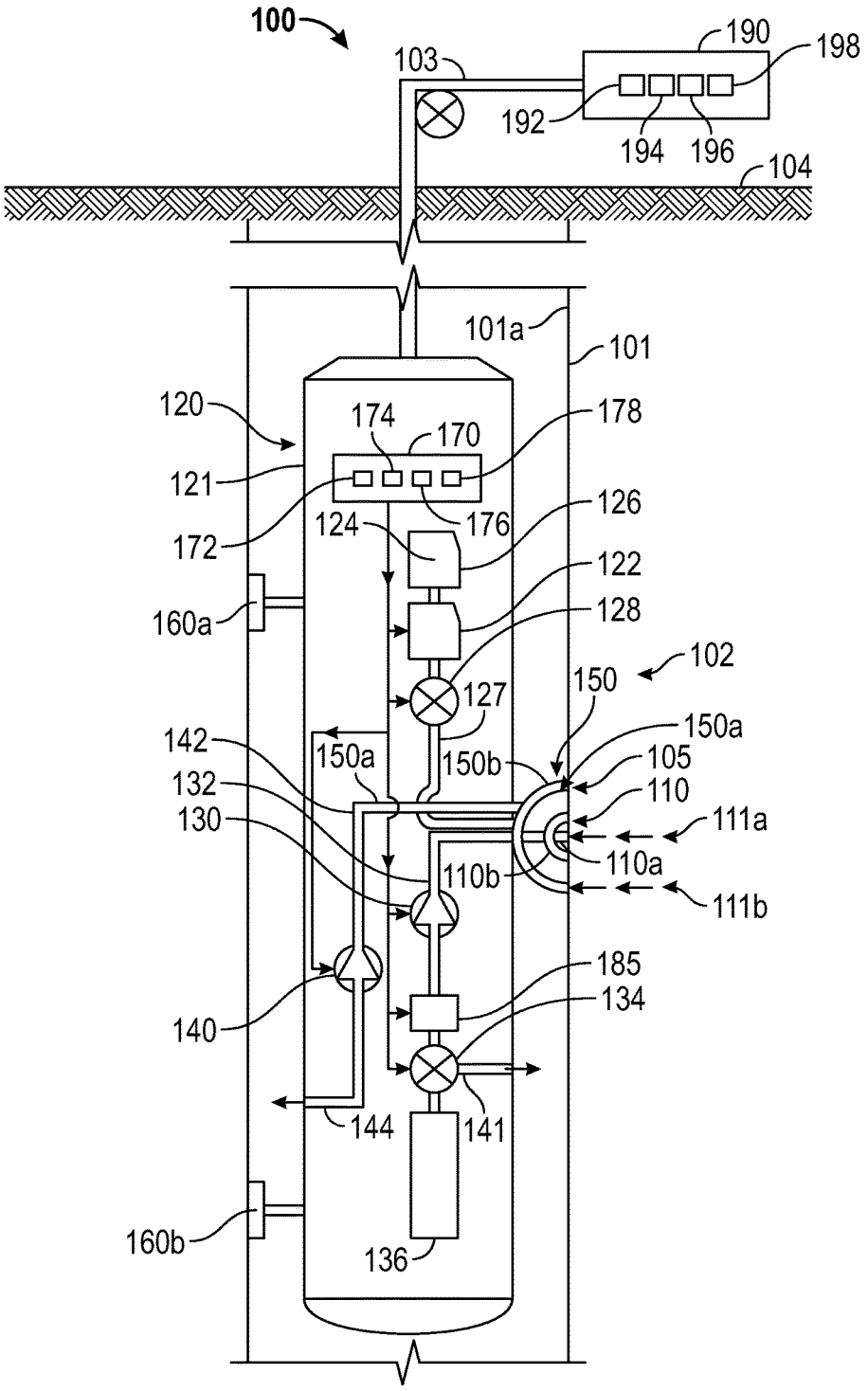
FIG. 1 is a schematic diagram of an exemplary formation evaluation system for obtaining formation fluid samples, according to one embodiment of the disclosure.

FIG. 1 is a schematic diagram of an exemplary formation evaluation system or formation testing system 100 for obtaining connate formation fluid samples and retrieving such samples for determining one or more properties of such fluid. The system 100 is shown to include a downhole formation evaluation tool 120 deployed in a wellbore 101 formed in a formation 102. The tool 120 is shown conveyed by a conveying member 103, such as a wireline or coiled tubing, from a surface location 104. In one embodiment, the tool 120 includes a fluid extraction or fluid withdrawal device 105 that includes an inner probe 110 and an outer probe 150. In one embodiment, probes 110 and 150 are concentric, as shown in FIG. 1. Probe 110 includes a fluid conduit or line 110*a* and a seal pad 110*b* around the conduit 110*a*. The outer probe 150 includes a conduit or fluid line 150*b* and a seal pad 150*a* around the conduit 150*b*. In one configuration, probes 110 and 150 may be extended from a tool body 121 radially outward toward wellbore wall 101*a*. A pump 122 supplies a fluid 124 under pressure from a fluid chamber 126 to probes 110 and 150 via a fluid line 127 to extend the probes 110 and 150 to urge the probes 110 and 150 against the inside wall 101*a* of the wellbore 101. Anchors 160*a* and 160*b* on the opposite side of the fluid withdrawal device 105 are extended so that the probes 110 and 150, when extended, will urge against the wellbore wall 101*a*. A valve 128 associated with or in line 127 may be provided to control the flow of the fluid 124 to the probes 110 and 150. In the probe configuration of FIG. 1, a common fluid 124 and a common hydraulic line 127 are utilized for extending probes 110 and 150. Separate pumps and supply lines may also be utilized.

A pump 130 is coupled to the inner probe 110 via a fluid line 132 for withdrawing fluid 111*a* from formation 102. To draw fluid 111*a* from formation 102, the pump 132 is activated and the fluid withdrawn may be pumped into a chamber 136 via a valve 134. Alternatively, the withdrawn fluid may be discharged into the well bore 101 via a fluid line 141. A pump 140 is coupled to the outer probe 150 via a fluid line 142 for withdrawing fluid 111*b* from formation 102. To draw fluid 111*b* from formation 102, the pump 140 is activated and the fluid withdrawn is discharged into the wellbore via a conduit 144.

The tool 120 further includes a controller 170 that contains circuits 172 for use in operating various components of the tool 120, a processor 174, such as a microprocessor, a storage device 176, such as a solid state memory and programs 178 accessible to the processor 174 for executing instruction contained therein. The system 100 also includes a controller 190 at the surface that contains circuits 192, a processor 194, storage device 196 and programs 198.

To obtain clean formation fluid samples, the tool 120 is conveyed and placed at a selected depth in the wellbore 101. Anchors 160*a* and 160*b* are activated to contact the wellbore wall 101*a*. The inner probe 110 and outer probe 150 are activated to urge against the wellbore wall 101*a* so that both the probes are sealed against the wellbore wall. In one aspect, both the inner and outer probes 110 and 150 are activated simultaneously or substantially simultaneously. Pumps 130 and 140 are activated to draw the formation fluid into their respective probes. Activating pump 140 causes the fluid 111*b* around the probe 110 to flow into the outer probe 150, while activating pump 130 causes the fluid 111*a* to flow into the inner probe 110. The initial fluid (111*a* and 111*b*) withdrawn is contaminated fluid as it is being withdrawn from the invaded zone. A fluid evaluation or testing device 185 may be used to determine when the fluid being withdrawn is sufficiently clean so that fluid samples may be collected. Any device, including, but not limited to, optical devices, may be utilized for determining contamination in the withdrawn fluid. As long as the fluid being withdrawn is not satisfactory, it may be discharged into the wellbore 101 via fluid lines 141 and 144. Once the fluid is clean, the valve 134 is operated to allow the fluid 111*a* from the inner probe 110 to enter the sample chamber 136. The outer probe 150 withdraws fluid around the inner probe and enables the inner fluid stream 111*a* to enter the inner probe. Such a mechanism allows for faster clean-up and prevents contaminated fluid from flowing into the inner probe. The pumps and valves in the tool may be controlled by the controller 170 according to instructions stored in programs 178 and/or instructions provided by the surface controller 190. Alternatively, controller 190 may control the operation of one or more devices in the tool 120 according to instructions provided by programs 198. An embodiment of the flow extraction device 105 is described in more detail in reference to FIGS. 2 and 3.

Figure 2:
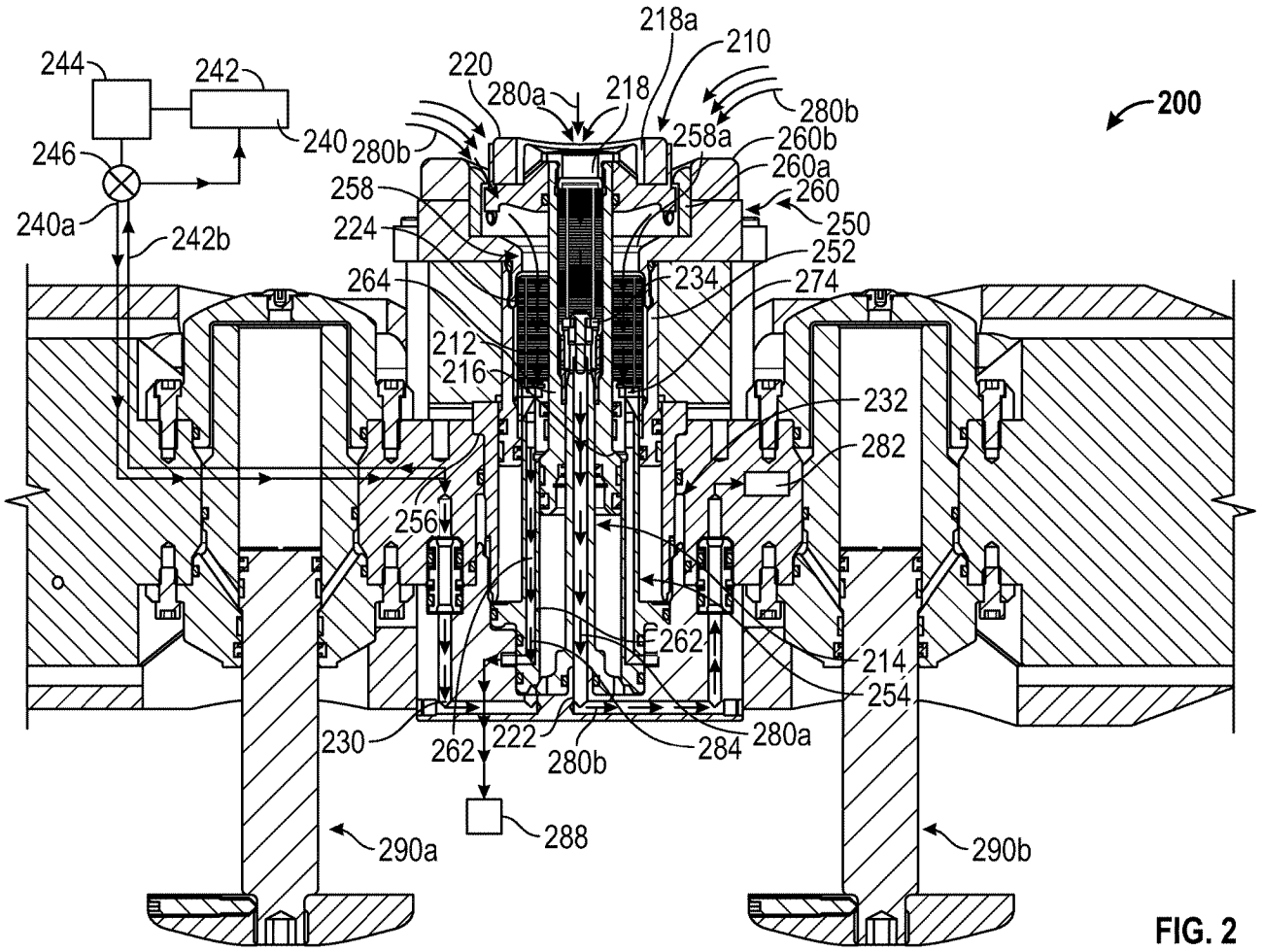
FIG. 2 shows a cross-section of a fluid extraction device in an extended position for use in a formation evaluation system, such as shown in FIG. 1, for obtaining formation fluid samples.

FIG. 2 shows an embodiment of a formation fluid collection device 200 in an extended position for obtaining formation fluid samples. The device 200 includes an inner probe 210 and an outer probe 250. In one embodiment, the inner probe 210 and the outer probe 250 are concentric, as shown in FIG. 1, wherein the outer probe 250 surrounds the inner probe 210. The inner probe 210 includes an inner piston 212 that reciprocates within an associated fluid chamber 214. In one aspect, a fluid 240 from a fluid source 242 may be supplied under pressure by a pump 244 to chamber 214 via a fluid conduit or fluid line 230 to cause the piston 212 to extend radially outward. Arrows 240*a* show path of the fluid from the source 242 to the fluid line 230. A control valve 246 may be provided to control the flow of the fluid 240 and also to lock the fluid in the chamber 214. A mechanical stop 216 may be provided to limit the extension of the piston 212. Similarly, in one configuration, the outer probe 250 includes a piston 252 that reciprocates within an associated fluid chamber 254. Fluid 240 from the source 242 or another suitable source (not shown) may be supplied under pressure to chamber 254 via a fluid conduit or fluid line 232 to cause the piston 252 to extend radially outward. A mechanical stop 256 may be provided to limit the extension of the outer piston 252. The outer probe 250 may also be locked while the fluid is withdrawn from the formation.

The inner probe 210 includes a fluid flow line 218 having an open end 218*a*. The inner probe 210 also includes a seal pad or sealing device 220 that provides a seal around the fluid line 218 when the seal pad 220 is urged against the formation. In one aspect, formation fluid 280*a* entering the inner probe 210 flows into a sample chamber 282 via a fluid path or fluid line 222. Alternatively, the fluid 280*a* may be discharged in the wellbore as shown in FIG. 1. A screen 224 is provided in the inner probe 210 to clean the formation fluid 280*a* entering the fluid line 222 before such fluid enters the sample chamber 282. In one embodiment, the inner screen 224 is fixed around a selected length of the flow line 218. In such a configuration, formation fluid 280*a* enters the flow line 218, passes through the inner screen 224 and then enters the flow line 222, thereby removing debris from the fluid 280*a* before it enters the flow line 222 and thus the sample chamber 282. The path of the fluid 280*a* from the formation to the sample chamber 282 is shown by line 280*b*. A fixed scraper 234 is provided to scrape or clean the inner screen 224 when the inner piston 212 is retracted from the extended position. In one aspect, the inner screen 224 may be designed so that all, or substantially all of the entire length of the screen 224 passes by the inner scraper 234 so that the combination of the fixed scraper 234 and moving screen 224 may substantially clean the screen when the screen 224 moves past the scraper 234.

Still referring to FIG. 2, the outer probe 250 includes a fluid line 258 having an open end 258*a*. The outer probe 250 includes a seal pad or sealing device 260 that provides a seal around the fluid line 258 when the seal pad 260 is urged against the formation. In one aspect, the seal pad 260 includes a metallic or substantially metallic member 260*a* surrounded by a non-metallic or substantially non-metallic member 260*b* to provide a seal around the outer probe 250. In one embodiment, when the member 260*b* extends to provide the seal, the member 260*a* is prevented from extending any further. Such a mechanism provides adequate seal and provides longer operating life for the seal member 260*b*. Formation fluid 280*b* entering the fluid line 258 flows into the wellbore or chamber 288 via a fluid path or fluid line 262. An outer screen 264 is provided to clean the formation fluid 280*b* entering the fluid line 262 before it is discharged to the wellbore or collected in chamber 288 for later use. In one embodiment, the outer screen 264 is fixed around a selected length of the fluid line 258. In such a configuration, formation fluid 280*b* enters the fluid line 258, passes through the outer screen 264 and then enters the fluid line 262, thereby removing debris from fluid 280*b* before it enters the wellbore or chamber 288. The path of the fluid 280*b* from the formation to the wellbore or chamber 288 is shown by line 284. A fixed scraper 274 is provided to scrape or clean the outer screen 264 when the outer piston 252 is retracted from the extended position. In one aspect, the outer screen 264 may be designed so that all or substantially all length of the outer screen 264 passes by the outer fixed scraper 274 so that the combination of the fixed scraper 274 and moving screen 264 may substantially clean the screen 264 when the screen 264 moves past the scraper 274. In the particular embodiment shown in FIG. 2, the outer probe 250 surrounds the inner probe 210, wherein the outer piston 250 surrounds a portion of the inner piston 212.

Referring to FIGS. 1 and 2, the device 200 includes a pair of extendable members or devices 290*a* and 290*b*, which, in one embodiment, may be hydraulically extended to provide opposing force to the probes 210 and 250 for setting the probes against the wellbore wall 101*a*. To obtain samples of fluid 280*a*, members 290*a* and 290*b* are extended against the wellbore wall 101*a*. In one aspect, a valve 246 is provided to prevent the fluid in chambers 214 and 254 from exiting, thus locking the pistons 212 and 252 in their extended positions. In one embodiment, the valve may be a check valve that can be opened, when desired, such as by using a hydraulic line or a solenoid, to release the trapped fluid volume in chambers 214 and/or 254. This prevents the tool body 121 to be sucked up toward the formation during drawdown of the formation fluid. This enables the probes to remain extended and maximize the contact area between the probe and the formation. Alternatively, a pump 244 may be used to supply hydraulic fluid 240 to chambers 214 via fluid line 230 and to chamber 254 via line 232. Fluid entering chamber 214 moves the inner piston 212 outward, which extends the inner probe 210 radially away from the tool body toward the wall 101*a* of the wellbore 101. Similarly, fluid 240 supplied to chamber 254 moves the outer piston 252 outward extending the outer probe 250 radially outward toward the wall 101*a* of the wellbore 101. The fluid 240 may be supplied until the probes 210 and 250 seal against the wellbore inside 101*a*. In one aspect, a common pump 244 may be utilized supply the fluid 240 to both the inner piston 212 and the outer piston 252 via a control valve 246 to control extension of the probes 210 and 250. The probes 210 and 250 may be locked in their respective extended positions by locking the flow of the fluid 240 through valve 246. To retract the probes, the valve 246 may be opened to enable the fluid from the inner piston to return to the chamber 242. Retracting the inner piston 212 causes the outer piston 252 to retract. In one aspect, the valve 246 may be an electrical or hydraulic valve controlled by the controller 170 and/or controller 190. In another aspect, the valve 246 may be a check valve that can be hydraulically opened to enable the fluid from pistons 212 and 252 to return to the chamber 242, as shown by line 242*b*.

Figure 3:
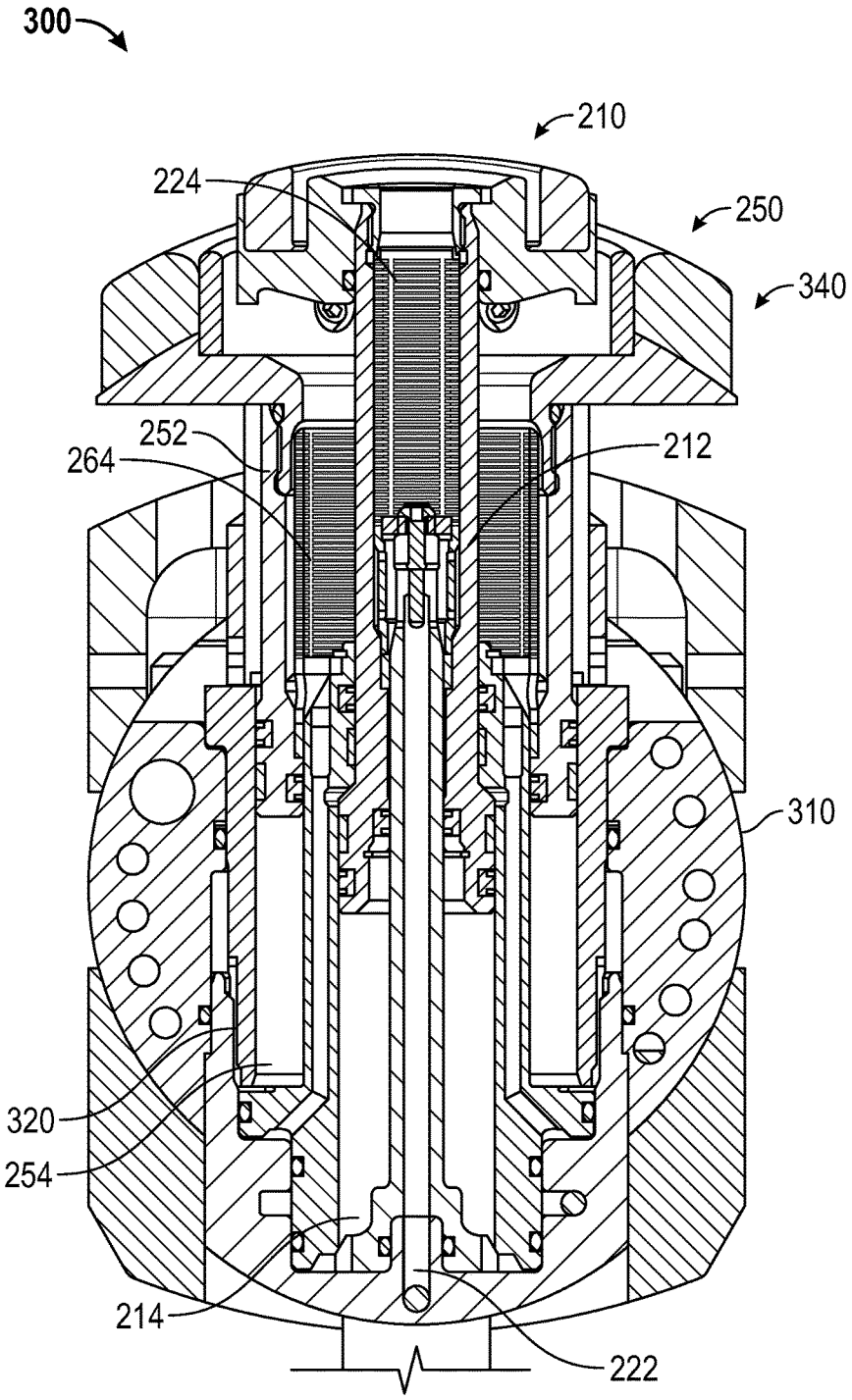
FIG. 3 is a module that contains certain components of the fluid extraction device shown in FIG. 2.

FIG. 3 shows a module 300 having a body 310 that includes a bore 320. The module 300 includes probes 210 and 250. In one embodiment, the inner piston 212, inner piston fluid chamber 214, outer piston 252 and outer piston fluid chamber are all placed or housed in the module 300. Also housed in the module 300 are the sample fluid line 222 and the fluid line 262 that for discharging the fluid from the outer probe 250 to the wellbore or chamber 288. Also included in the module 300 are inner screen 224 and outer screen 264. Placing such components of both the inner and outer probes in a module enables providing a relatively small assembly, such as the module 300 shown in FIG. 1, which is desirable in downhole tools. Also, there exist a large number of formation evaluation tools that utilize a single probe. The module 300 may be dimensioned so that a single probe tool may be retrofitted with a dual probe device, such as device 300.

The formation evaluation system 100 has been described in reference to a wireline system for obtaining formation fluid samples. The devices and methods described for obtaining the fluid samples in reference to FIGS. 2 and 3 and variations thereof may be utilized in a drilling assembly (also referred to as a bottomhole assembly) for obtaining formation fluid samples during drilling of a wellbore, such as wellbore 101.

While the foregoing disclosure is directed to the embodiments of the disclosure, various modifications will be apparent to those skilled in the art. It is intended that all variations within the scope and spirit of the appended claims be embraced by the foregoing disclosure.

The invention claimed is:

1. An apparatus for obtaining a fluid from a formation, comprising:

a fluid extraction device that includes:

an inner probe and an outer probe extendable from a tool body;

an inner filter provided in a selected length of the inner probe, wherein fluid from the formation entering the inner probe passes through the inner filter and into a first fluid line;

an outer filter provided in the outer probe extendable from the tool body with the outer probe, wherein fluid from the formation entering the outer probe passes through the outer filter and into a second fluid line, wherein the inner filter is extendable from the tool body with the inner probe and the outer filter is extendable from the tool body with the outer probe and the outer filter surrounds the inner filter; and an inner scraper at a fixed location within the tool, wherein retracting the inner probe from an extended position moves the inner filter past the inner scraper to clean the inner filter, and an outer scraper at a fixed location within the tool, wherein retracting the outer probe from an extended position moves the outer filter past the outer scraper to clean the outer filter.

2. The apparatus of claim 1, wherein retracting one of the inner probe and the outer probe retracts the other of the inner probe and the outer probe.

3. The apparatus of claim 1 further comprising:

a first chamber in which a first piston reciprocates to extend and retract the inner probe and a second chamber in which a second piston reciprocates to extend and retract the outer probe; and a common pump for pumping a hydraulic fluid in the first chamber and the second chamber to cause the first piston and the second piston to extend from the tool body.

4. The apparatus of claim 3 further comprising a valve for controlling flow of the hydraulic fluid into the first chamber and the second chamber.

5. The apparatus of claim 4, wherein the valve is selected from a group consisting of: a check valve with a bleed-off; and an electrically operated three-way valve.

6. The apparatus of claim 1, wherein the fluid extraction device includes at least one carrier for collecting the contaminated formation fluid from the second fluid line.

7. The apparatus of claim 1 further comprising at least one of: a first mechanical stop that defines the maximum extension of the inner probe and a second mechanical stop that defines maximum extension of the outer probe.

8. The apparatus of claim 1, wherein the inner probe is surrounded by the outer probe and wherein the outer probe includes a metallic member and a substantially non-metallic member configured to contact the formation when the outer probe extends to contact the formation, wherein the substantially non-metallic member is configured not to compress when the metallic member contacts the formation.

9. The apparatus of claim 1, wherein the inner probe, outer probe, the inner scraper and the outer scraper are disposed in a common cavity.

10. The apparatus of claim 1, wherein the inner probe and the outer probe extend substantially simultaneously.

11. A method of obtaining a fluid from a formation, comprising:

providing a tool that includes an inner probe and an outer probe independently extendable from a tool body, and an inner filter provided in a selected length of the inner probe, wherein fluid from the formation entering the inner probe passes through the inner filter and into a first fluid line, and an outer filter provided in the outer probe, wherein fluid from the formation entering the outer probe passes through the outer filter and into a second fluid line, wherein the inner filter is extendable from the tool body with the inner probe and the outer filter is extendable from the tool body with the outer probe, an inner scraper at a fixed location within the tool, wherein retracting the inner probe from an extended position moves the inner filter past the inner scraper to clean the inner filter, and an outer scraper at a fixed location within the tool, wherein retracting the outer probe from an extended position moves the outer filter past the outer scraper to clean the outer scraper, wherein the outer filter surrounds the inner filter;

conveying the tool in a wellbore;

extending the inner probe and the outer probe to contact an inside wall of the wellbore;

extracting fluid from the formation via the outer probe and determining when such extracted fluid is substantially free of contamination;

extracting fluid from the formation via the inner probe after determining the extracted fluid is substantially free of contamination and collecting such fluid in a chamber; and retracting the inner probe to move the inner filter past the inner scraper to clean the inner filter and retracting the outer probe to move the outer filter past the outer scraper to clean the outer filter.

12. The method of claim 11 further comprising discharging the fluid extracted via the outer probe into the wellbore.

13. The method of claim 11 further comprising utilizing an optical device for determining when the fluid extracted via the outer probe is free of contamination.

14. The method of claim 11, wherein extending the inner probe and the outer probe comprises using a common pump and fluid source to supply a hydraulic fluid to the inner probe and the outer probe to extend the inner probe and the outer probe.

15. The method of claim 11 further comprising extending the inner probe beyond the outer probe for obtaining the fluid from the formation.

16. The method of claim 11, wherein the tool is a component of one of: a wireline tool; and a drilling tool.

17. The method of claim 11 further comprising filtering the fluid received in the inner probe before collecting such fluid in a chamber.

18. The method of claim 11 further comprising providing a first mechanical stop for limiting extension of the inner probe and a second mechanical stop for limiting extension of the outer probe.

19. The method of claim 11 further comprising locking one of the: inner probe by locking a fluid volume associated with the inner probe; outer probe by locking a fluid volume associated with the outer probe; and locking both the inner probe and the outer probe by locking fluid volumes associated with the inner and the outer probes.

20. The method of claim 19, wherein locking a fluid volume associated with one of the inner probe and the outer probe locks a piston associated with one of the inner probe and the outer probe.

* * * * *